US010014620B2

(12) United States Patent
Endo et al.

(10) Patent No.: US 10,014,620 B2
(45) Date of Patent: Jul. 3, 2018

(54) DOWNSIZING OF A CONNECTOR HAVING A CONNECTOR POSITION ASSURANCE FUNCTION

(71) Applicant: Dai-ichi Seiko Co., Ltd., Kyoto-shi, Kyoto (JP)

(72) Inventors: Takayoshi Endo, Shizuoka (JP); Sakai Yagi, Shizuoka (JP); Jun Mukunoki, Shizuoka (JP); Takuya Takeda, Shizuoka (JP)

(73) Assignee: DAI-ICHI SEIKO CO., LTD., Kyoto-Shi, Kyoto (JP)

( * ) Notice: Subject to any disclaimer, the term of this patent is extended or adjusted under 35 U.S.C. 154(b) by 42 days.

(21) Appl. No.: 15/431,598

(22) Filed: Feb. 13, 2017

(65) Prior Publication Data

US 2017/0250492 A1 Aug. 31, 2017

(30) Foreign Application Priority Data

Feb. 25, 2016 (JP) ..... 2016-034895

(51) Int. Cl.
*H01R 13/627* (2006.01)
*H01R 13/508* (2006.01)
*H01R 13/426* (2006.01)

(52) U.S. Cl.
CPC ..... *H01R 13/508* (2013.01); *H01R 13/426* (2013.01)

(58) Field of Classification Search
CPC ..... H01R 13/508; H01R 13/426
USPC ..... 439/656
See application file for complete search history.

(56) References Cited

FOREIGN PATENT DOCUMENTS

| | | | | |
|---|---|---|---|---|
| EP | 0655807 | A2 * | 5/1995 | ..... H04R 13/6272 |
| EP | 1369964 | A1 | 12/2003 | |
| JP | 2000-058199 | A | 2/2000 | |
| JP | 4657034 | B2 | 3/2011 | |
| WO | 2009047744 | A2 | 4/2009 | |
| WO | 2013092310 | A1 | 6/2013 | |
| WO | WO 2013092310 | A1 * | 6/2013 | ..... H04R 13/639 |

OTHER PUBLICATIONS

Extended European Search Report (EP Application No./Patent No. EP17157290.2-1801); dated Jun. 23, 2017; 8 pages.

* cited by examiner

*Primary Examiner* — Abdullah Riyami
*Assistant Examiner* — Nader Alhawamdeh
(74) *Attorney, Agent, or Firm* — Howard & Howard Attorneys PLLC

(57) ABSTRACT

A connector includes an outer housing including an engagement catch, an inner housing and a sliding member. The inner housing includes an engagement latch, and a pair of locking arms each provided with the engagement latch. The inner housing includes a slide channel having the pair of locking arms disposed at both sides. The sliding member includes a pair of latching arms each provided with a latch. When the first housing and the second housing are engaged with each other, the first housing and the second housing allow the sliding member to pass through the slide channel, and when the sliding member slides the slide channel, the pair of latching arms are deflected so as to decrease a gap therebetween by depressions from the respective locking arms.

5 Claims, 18 Drawing Sheets

DOWNSIZING OF A CONNECTOR HAVING A CONNECTOR POSITION ASSURANCE FUNCTION

CROSS-REFERENCE TO RELATED APPLICATION

This application claims the benefit of Japanese Patent Application No. 2016-34895, filed on Feb. 25, 2016, the entire disclosure of which is incorporated by reference herein.

TECHNICAL FIELD

This application relates generally to a connector.

BACKGROUND ART

Japan Patent No. 4657034 discloses a connector that has a Connector Position Assurance (CPA) function. This connector includes a first housing, a second housing to be engaged with the first housing, and further a sliding member. The sliding member is attached to the second housing in a slidable manner from a first position (stand-by position) that is an initial portion to a predetermined second position (engagement locking position) upon completion of the engagement of the second housing with the first housing. This sliding member serves as a CPA member that enables a user to check the completion of the engagement of both the housings by a sliding action from the first position to the second position.

SUMMARY OF INVENTION

In the connector disclosed in Japan Patent No. 4657034, the sliding member includes a pair of arms each provided with a pawl (latching part) at the leading end. In accordance with the advancement of the sliding action of the sliding member from the first position to the second position, such arms are deflected in the direction spreading from each other. Hence, the second housing needs to have a space by what corresponds to the deflection of the arms in the spreading direction. This increases the dimension of the second housing, and thus the dimension of the entire connector may increase.

The present disclosure has been made in view of the foregoing circumstances, and an objective is to accomplish a downsizing of a connector while accomplishing a connector position assurance function.

In order to accomplish the above objective, a connector according to an aspect of the present disclosure includes:

a first housing including an engagement catch;

a second housing including an engagement latch to latch the engagement catch, a pair of locking arms each provided with the engagement latch, and a slide channel having the pair of locking arms disposed at both sides, the second housing being to be engaged with the first housing; and a sliding member including a pair of arms each provided with a latch, in which:

when the first housing and the second housing are engaged with each other, the first housing and the second housing may allow the sliding member to pass through the slide channel; and when the sliding member slides the slide channel, the pair of arms are deflected so as to decrease a gap therebetween by depressions from the respective locking arms, and when the latches go over the respective locking arms, the gap between the pair of arms increases, the increase in the gap enabling the locking arms to be latched by the respective latches.

The sliding member may include a protrusion; and the engagement latch may be latched by the protrusion to restrict a sliding action of the sliding member until the engagement catch is latched by the engagement latch for the engagement between the first and second housings, when the engagement catch is latched by the engagement latch, the latching between the protrusion and the engagement latch may be canceled and the canceling of the latching between the protrusion and the engagement latch may enable the sliding member to pass through the slide channel.

The pair of arms may each include a tentative latch that prevents a movement in an opposite direction to the sliding action upon latching each of the locking arms of the second housing, and the tentative latch may be provided ahead of the latch toward a leading end.

The respective latches of the pair of arms may be formed in a shape protruding outwardly relative to each other.

The respective first and second housings may be housings of the connector that includes a terminal connected to a wiring.

According to the present disclosure, the pair of arms are deflected so as to decrease the gap therebetween upon depression by the locking arm. This eliminates the necessity of having a space in the second housing by what corresponds to the deflection of the arms in the spreading direction. Consequently, a downsizing of the connector is accomplished while also accomplishing a connector position assurance function.

BRIEF DESCRIPTION OF THE DRAWINGS

A more complete understanding of this application can be obtained when the following detailed description is considered in conjunction with the following drawings, in which:

FIG. 6A is a (first) cross-sectional view taken along a line A-A in FIG. 5, while FIG. 6B is a cross-sectional view taken along a line B-B in FIG. 6A;

FIG. 7A is a (second) cross-sectional view taken along a line A-A in FIG. 5, while FIG. 7B is a cross-sectional view taken along a line C-C in FIG. 7A;

DETAILED DESCRIPTION OF THE EMBODIMENT

An explanation will be given of a connector 1 according to an embodiment of the present disclosure with reference to FIGS. 1 to 25. In order to facilitate understanding, an XYZ coordinate system is defined, and will be referred as appropriate.

Figure 1:
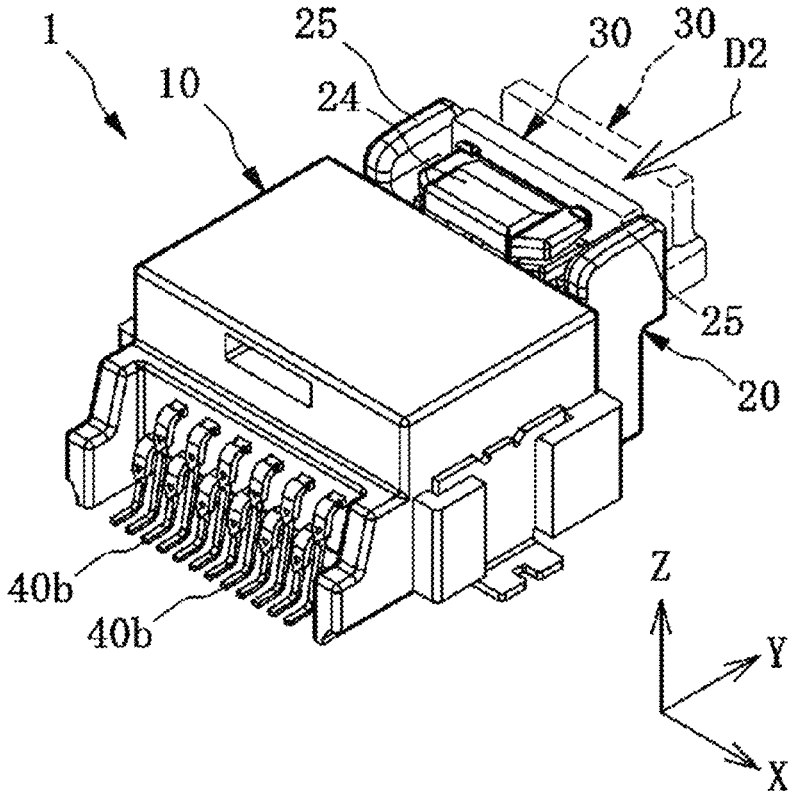
FIG. 1 is a perspective view of a connector according to an embodiment of the present disclosure.
Figure 2:
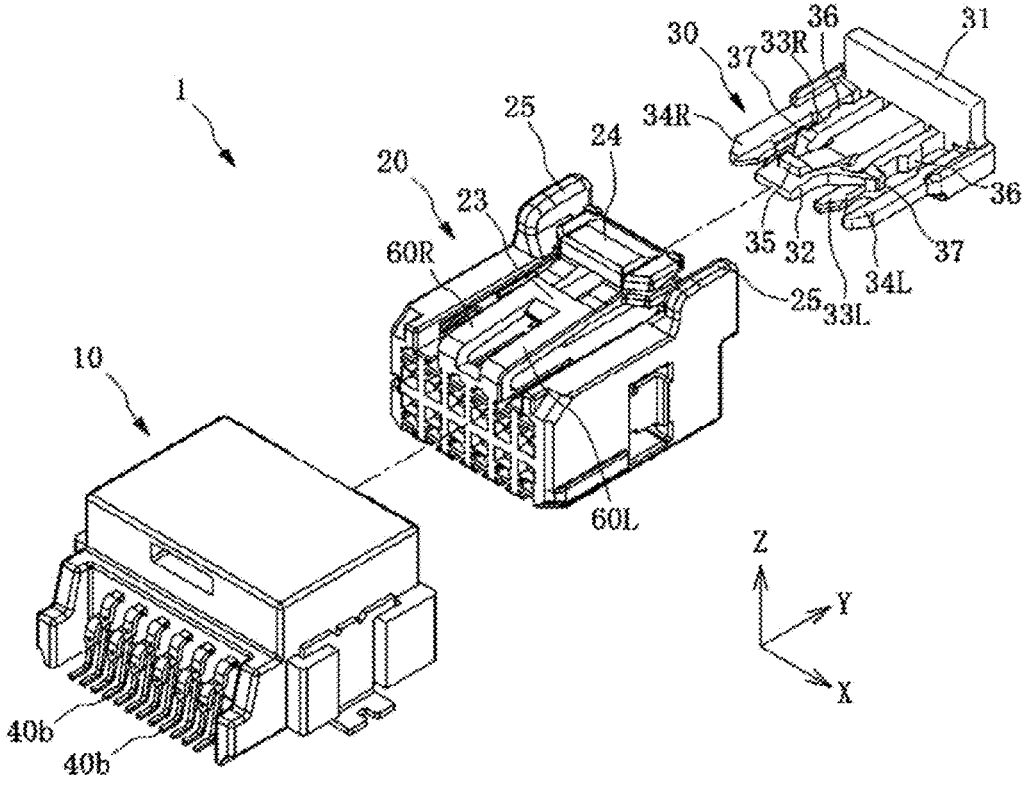
FIG. 2 is an exploded perspective view of the connector.

The connector 1 is applied to, for example, electronic circuit components for an automobile, and has a Connector Position Assurance (CPA) function. As illustrated in FIGS. 1 and 2, the connector 1 includes an outer housing 10, an inner housing 20, and a sliding member 30 (CPA member) that becomes able to slide upon engagement of both the outer housing 10 and the inner housing 20.

Figure 3:
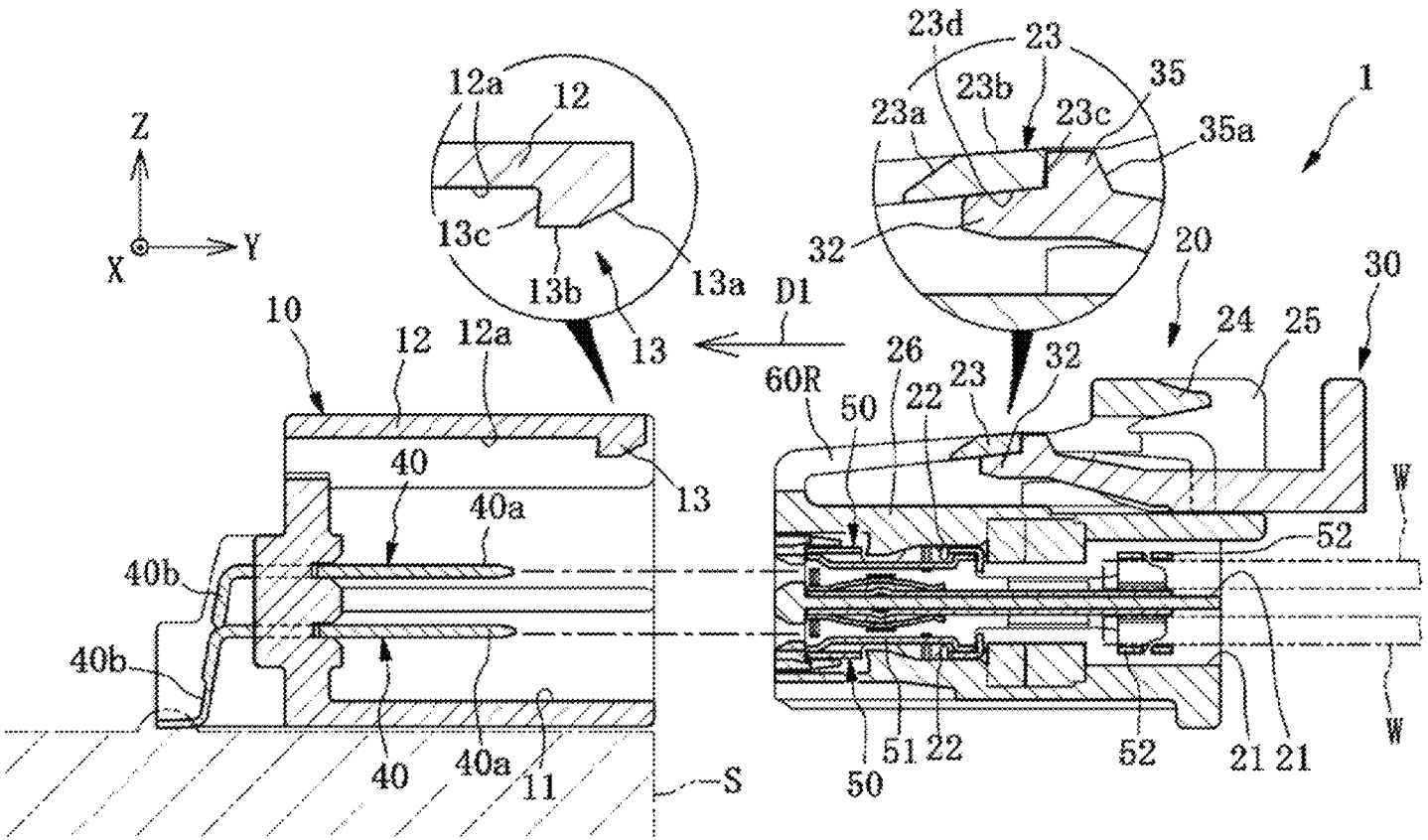
FIG. 3 is an exploded YZ cross-sectional view of the connector.

As illustrated in FIG. 3, in this embodiment, the outer housing 10 is a housing of a receptacle connector mounted on a wiring board S. The outer housing 10 is formed of a plastic, and is formed by, for example, injection molding. The outer housing 10 is assembled with multiple male terminals 40.

Each male terminal 40 is formed of a conductive material. The male terminal 40 has an end 40*a* at the +Y side and an end 40*b* at the −Y side both protruding from the outer housing 10. The end 40*a* of the male terminal 40 at the +Y side protrudes to the interior of an engagement opening 11 formed in the outer housing 10. The end 40*b* of the male terminal 40 at the −Y side is exposed from the rear end surface of the outer housing 10 at the −Y side, is curved in a substantially S-shape, and protrudes in parallel with the −Y direction. The end 40*b* of the male terminal 40 is applied as an external lead to be soldered to the wiring board S.

The outer housing 10 is a member formed in a substantially box shape in which the engagement opening 11 opened in the +Y direction is formed. The inner housing 20 is to be fitted in the engagement opening 11 of the outer housing 10. A fitting direction D1 in which the inner housing 20 is fitted in the outer housing 10 is consistent with the −Y direction. In addition, the outer housing 10 includes an engagement catch 13.

The engagement catch 13 is formed on a lower surface 12*a* of a ceiling wall 12 that is a part of wall defining the outer housing 10 at the nearby location to the +Y side. The engagement catch 13 includes, from the rear end side (+Y side) in the fitting direction D1 in sequence, an inclined surface 13*a*, a parallel surface 13*b*, and a standing-upright surface 13*c*. The inclined surface 13*a* includes a surface inclined relative to the fitting direction D1. The parallel surface 13*b* includes a parallel surface to the fitting direction D1. The standing-upright surface 13*c* includes a surface substantially in parallel with the Z-axis direction.

The inner housing 20 is a housing of a plug connector to which wirings W are connected in this embodiment. The inner housing 20 is formed of a plastic, and is formed by, for example, injection molding. Multiple female terminals 50 are fitted in this inner housing 20.

Each female terminal 50 is formed by, for example, bending a conductive sheet metal. A cylindrical part 51 which is formed in a substantially rectangular cylindrical shape, and in which the end 40*a* of each male terminal 40 at the +Y side is fitted is formed at the end of the female terminal 50 at the −Y side. The cylindrical part 51 includes an elastic contact piece to be in contact with the end 40*a* of the male terminal 40. The end 40*a* of the male terminal 40 fitted in the cylindrical part 51 is conductively fastened by the elastic force of the elastic contact piece of the cylindrical part 51. In addition, a binding part 52 that attaches and fastens the wirings W by pressure which are fitted therein is formed at the end of the female terminal 50 at the +Y side.

Figure 4:
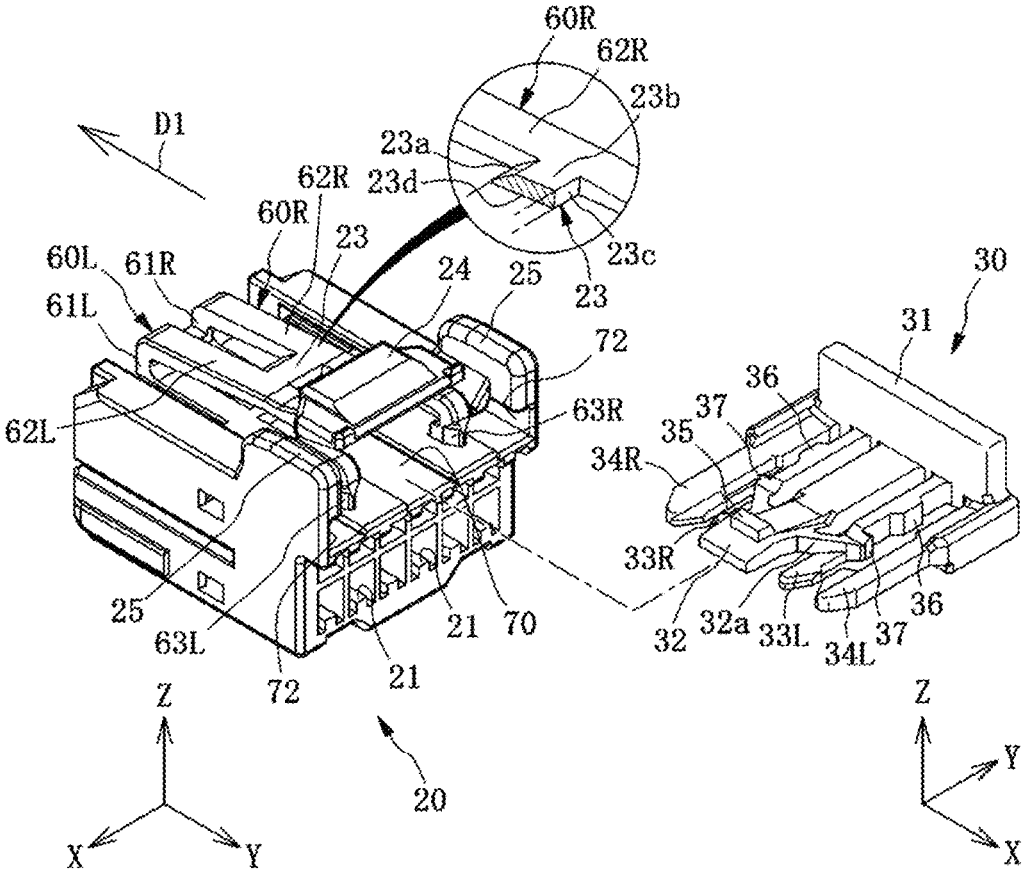
FIG. 4 is a perspective view of an inner housing and of a sliding member.

The inner housing 20 is formed in a substantially cuboid shape that has the lengthwise direction substantially in parallel with the Y-axis direction. As illustrated in FIG. 4, multiple terminal fitting openings 21 in which the respective female terminals 50 are fitted are formed in the rear end surface (the end surface at the +Y side) of the inner housing 20. As illustrated in FIG. 3, each terminal fitting opening 21 is in communication with a terminal retaining room 22 formed inside the inner housing 20.

As illustrated in FIGS. 3, 4, the inner housing 20 includes an engagement latch 23, a latching release 24, ribs 25, and a pair of locking arms 60R, 60L.

The engagement catch 13 of the outer housing 10 is to be latched by the engagement latch 23. The engagement latch 23 is provided between the locking arm 60R and the locking arm 60L so as to interlink the locking arm 60R with the locking arm 60L. The engagement latch 23 includes, from the leading end side (−Y side) in the fitting direction D1 of the inner housing 20 in sequence, an inclined surface 23*a*, an upper parallel surface 23*b*, a lower parallel surface 23*d*, and a standing-upright surface 23*c*. The inclined surface 23*a* includes an inclined surface relative to the fitting direction D1. The upper parallel surface 23*b* and the lower parallel surface 23*d* are each include a plane. The inclined surface 23*a* and the upper parallel surface 23*b* are utilized as to-be-guided surfaces that are guided by the engagement catch 13 in accordance with the advancement of the engagement between the outer housing 10 and the inner housing 20. The standing-upright surface 23*c* includes a surface substantially in parallel with the Z-axis direction. When the standing-upright surface 23*c* faces the standing-upright surface 13*c* of the engagement catch 13, the latching between the engagement latch 23 and the engagement catch 13 completes. The lower parallel surface 23*d* is utilized as a guide surface that guides a protrusion 35 of the sliding member 30 in accordance with the sliding action of the sliding member 30.

In addition, the engagement latch 23 is to be also latched by the protrusion 35 of the sliding member 30. Hence, the engagement latch 23 also serves as a protrusion catch.

The latching release 24 is provided on the locking arms 60R, 60L. When a user depresses the latching release 24, the latching between the engagement latch 23 and the engagement catch 13 is released. This latching release enables the user to pull out the inner housing 20 from the outer housing 10.

As illustrated in FIG. 4, the ribs 25 are formed so as to improve the rigidity and strength of the inner housing 20. The ribs 25 are formed along the Y-axis direction.

Figure 5:
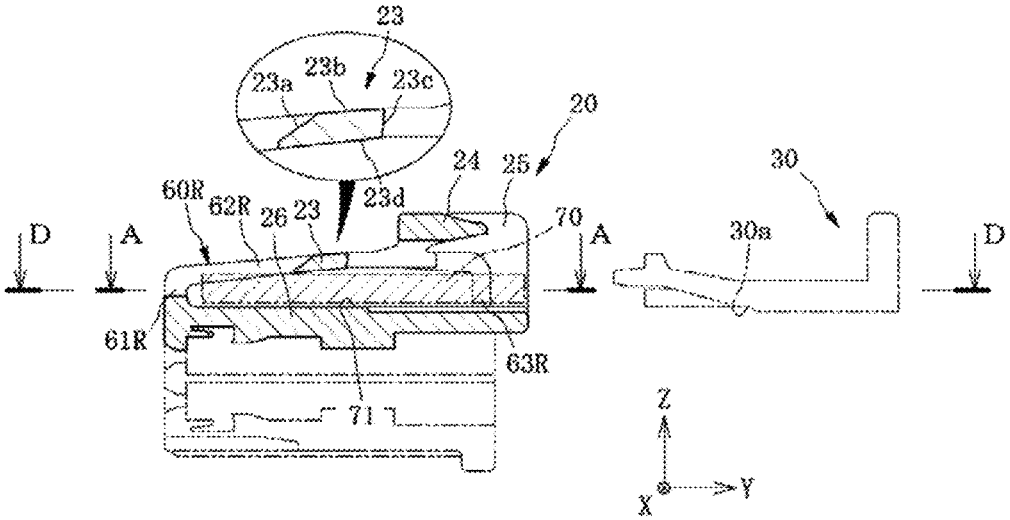
FIG. 5 is a schematic cross-sectional view of the inner housing for explaining a slide channel.

As illustrated in FIG. 5, the locking arm 60R includes a leading-end-side locking arm part 61R, a parallel locking arm part 62R, and a rear-end-side locking arm part 63R. In this embodiment, the leading-end-side locking arm part 61R is formed so as to extend in the vertical direction from the nearby location to the leading end part (−Y side end part) of a ceiling wall 26 that is a part of wall defining the inner housing 20. However, the leading-end-side locking arm part 61R may be extended in directions other than the vertical direction. In this embodiment, the rear-end-side locking arm part 63R is extended in the vertical direction from the nearby location to the rear end part (+Y side end part) of the ceiling wall 26. However, the rear-end-side locking arm part 63R may be extended in directions other than the vertical direction. The parallel locking arm part 62R interlinks the leading-end-side locking arm part 61R with the rear-end-side locking arm part 63R, and is formed substantially in parallel with the Y-axis direction.

The locking arm 60L employs the similar structure to that of the locking arm 60R. More specifically, as illustrated in FIG. 4, the locking arm 60L includes a leading-end-side locking arm part 61L, a parallel locking arm part 62L, and a rear-end-side locking arm part 63L. The rear-end-side locking arm part 63L is extended in the vertical direction in this embodiment, but may be extended in directions other than the vertical direction.

The locking arms 60R, 60L employing the above structure are formed so as to be deflectable in accordance with the advancement of engagement between the outer housing 10 and the inner housing 20.

In addition, as illustrated in FIG. 4, the inner housing 20 is provided with a slide channel 70 extended along the Y-axis direction, and rails 72 formed on the opposing surfaces of the respective ribs 25 facing with each other.

As illustrated in FIG. 5, the slide channel 70 allows the sliding member 30 to slide, and is formed so as to allow the sliding member 30 to pass through upon engagement between the two housings. The sliding passage 70 is provided at the upper side (+Z side) of the ceiling wall 26 of the inner housing 20. The sliding passage 70 is formed with a slide surface 71 that faces a lower surface 30*a* (the surface at the −Z side) of the sliding member 30 when the sliding member 30 slides.

Figure 6A:
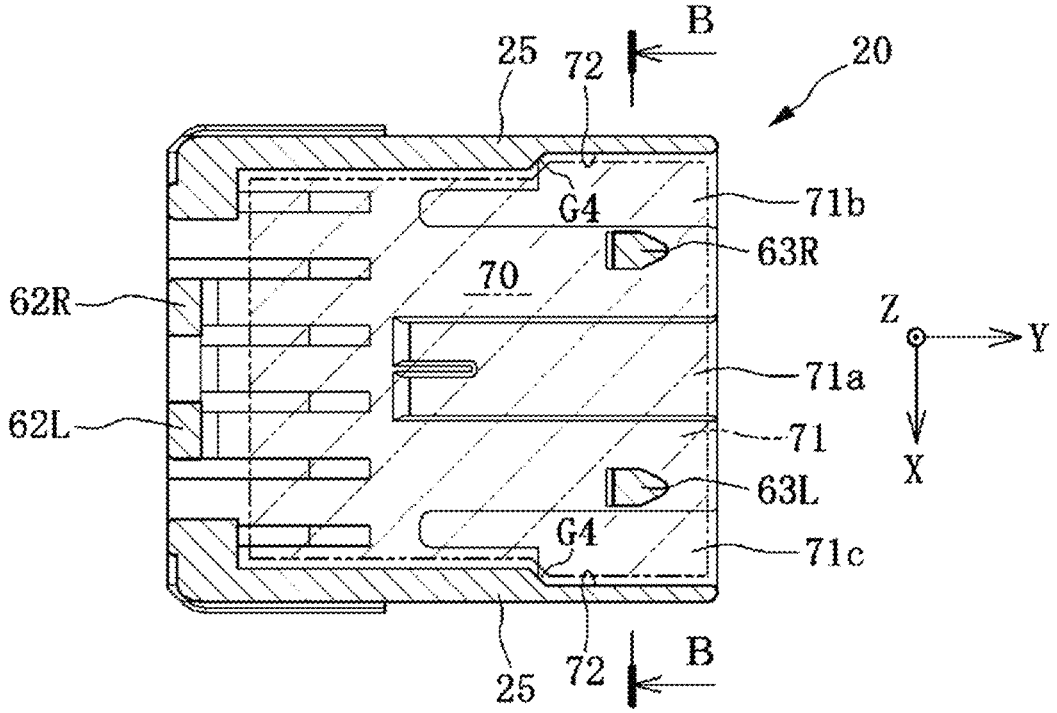
FIGS. 6A and 6B are each a diagram for explaining the slide channel.
Figure 6B:
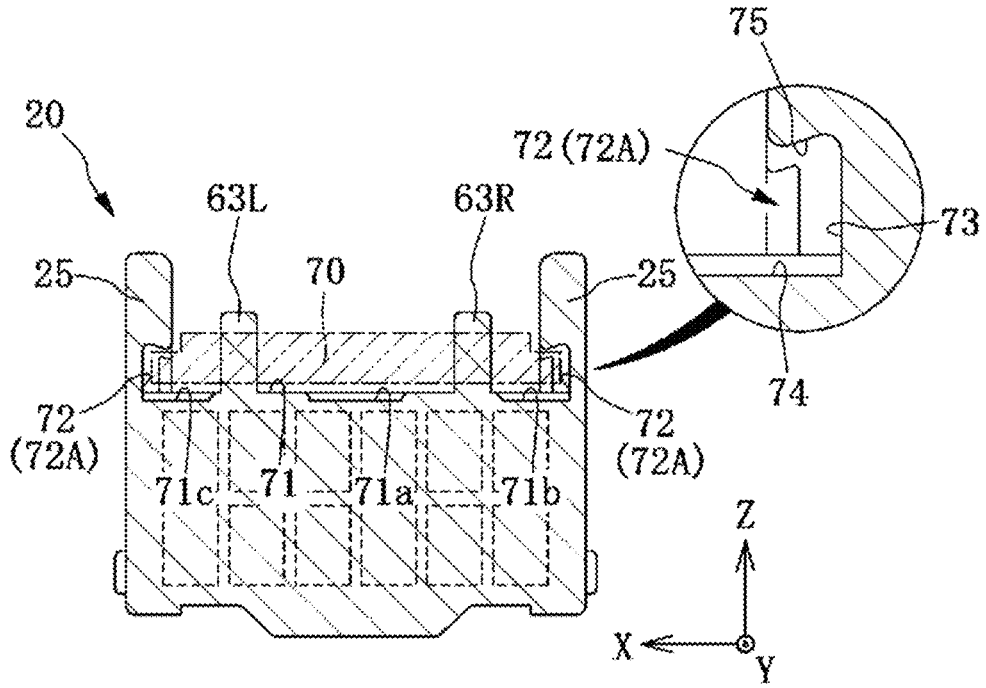

FIGS. 6A and 6B are each a diagram for explaining the slide channel 70, and FIG. 6A is a cross-sectional view taken along a line A-A in FIG. 5, while FIG. 6B is a cross-sectional view taken along a line B-B in FIG. 6A. In FIG. 6B, some structural components, such as the latching release 24, and the locking arms 60R, 60L, are omitted.

As illustrated in FIGS. 6A, 6B, the rear-end-side locking arm parts 63R, 63L are disposed at both sides of the slide channel 70, respectively. In addition, the slide surface 71 is formed with engagement parts 71*a*, 71*b*, and 71*c*. The engagement parts 71*a*, 71*b*, and 71*c* are each formed as a recess that has a bottom. The bottom surface of each engagement part 71*a*, 71*b*, 71*c* is an offset surface from the slide surface 71 in the −Z direction, and is a parallel surface to the sliding surface 71.

Figure 7A:
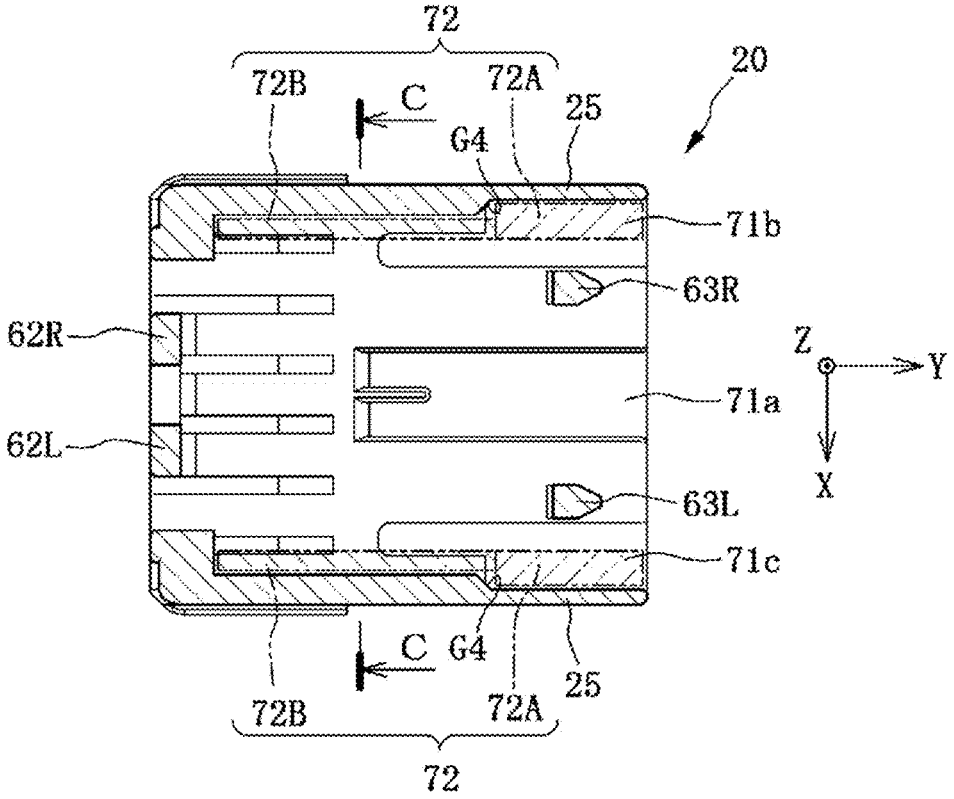
FIGS. 7A and 7B are each a diagram for explaining a rail.
Figure 7B:
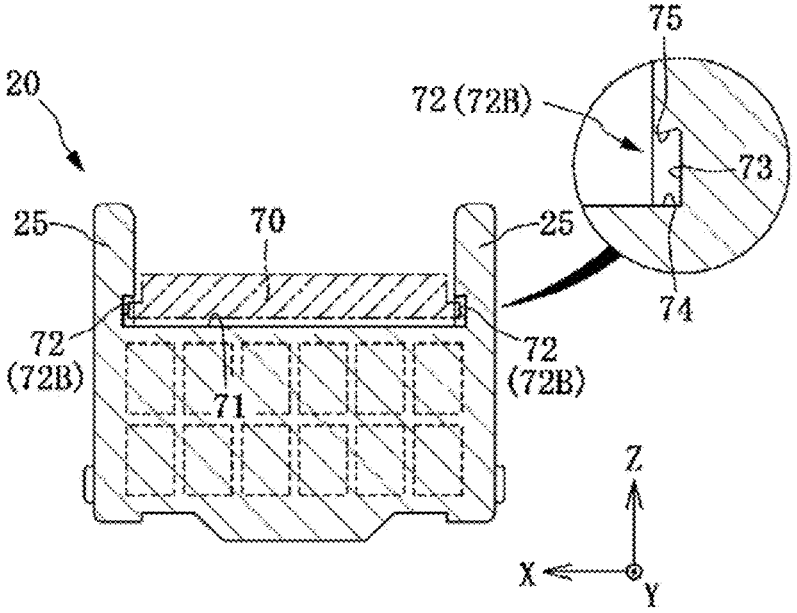

FIG. 7A is a cross-sectional view taken along the line A-A in FIG. 5 for explaining the rails 72. FIG. 7B is a cross-sectional view taken along a line C-C in FIG. 7A. In FIG. 7B, the latching release 24, the locking arms 60R, 60L, and the like, are omitted.

As illustrated in FIG. 7A, each rail 72 is formed so as to retract therein the rib 25, and is formed as a groove. Each rail 72 includes a first rail part 72A and a second rail part 72B that have different lateral cross-sectional areas (the area of the XZ cross-section) from each other. The first rail part 72A has the larger lateral cross-sectional area than that of the second rail part 72B. The rail 72 (more specifically, the first rail part 72A and the second rail part 72B) is formed in, as illustrated in FIG. 6B and FIG. 7B, a recess that includes a bottom surface 73, a first side surface 74, and a second side surface 75. The bottom surface 73 is a parallel surface to the YZ plane. In this embodiment, the first side surface 74 forms a part of the slide surface 71. In this embodiment, although the first side surface 74 is a part of the slide surface 71, the present disclosure is not limited to this example structure, and may be not a part of the slide surface 71. The second side surface 75 is formed so as to be inclined relative to the slide surface 71. The respective second side surfaces 75 of the first rail part 72A and the second rail part 72B have the substantially equal inclination angle to each other.

In addition, as illustrated in FIG. 6A, provided at a connection section between the first rail part 72A and the second rail part 72B is a guide surface G4 that is inclined relative to the Y-axis direction. This guide surface G4 guides the fitting of the sliding member 30 into the inner housing 20 at the time of manufacturing and assembling of the connector 1 to improve the fitting easiness, thereby improving the assembling workability.

Figure 8:
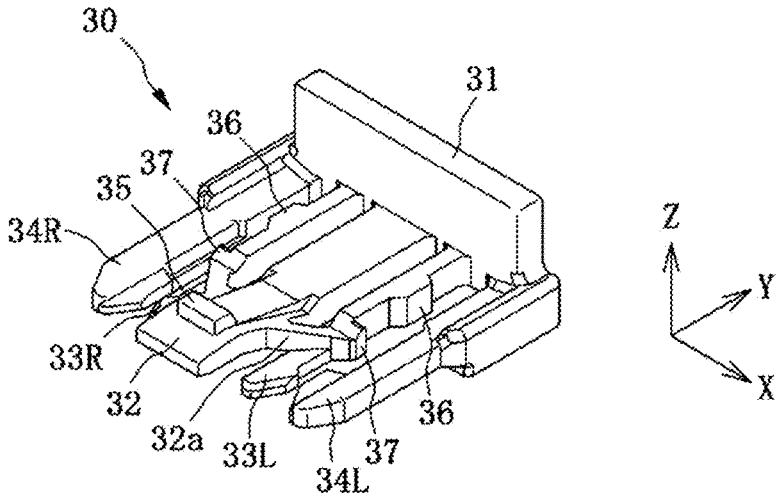
FIG. 8 is a (first) perspective view of the sliding member.

The sliding member 30 serves as the CPA (Connector Position Assurance) member that locks the engagement between both the outer and inner housings 10, 20. The sliding member 30 is applied so as to allow the user to check whether or not the engagement between both the outer and inner housings 10, 20 is fully completed within the engagement work. As illustrated in FIG. 8, the sliding member 30 includes a sliding member base 31, a main arm 32 protruding from the sliding member base 31, a pair of latching arms 33R, 33L, and a pair of support arms 34R, 34L.

The sliding member base 31 is utilized as a depressed part to be depressed by the user when the user slides the sliding member 30.

Figure 9A:
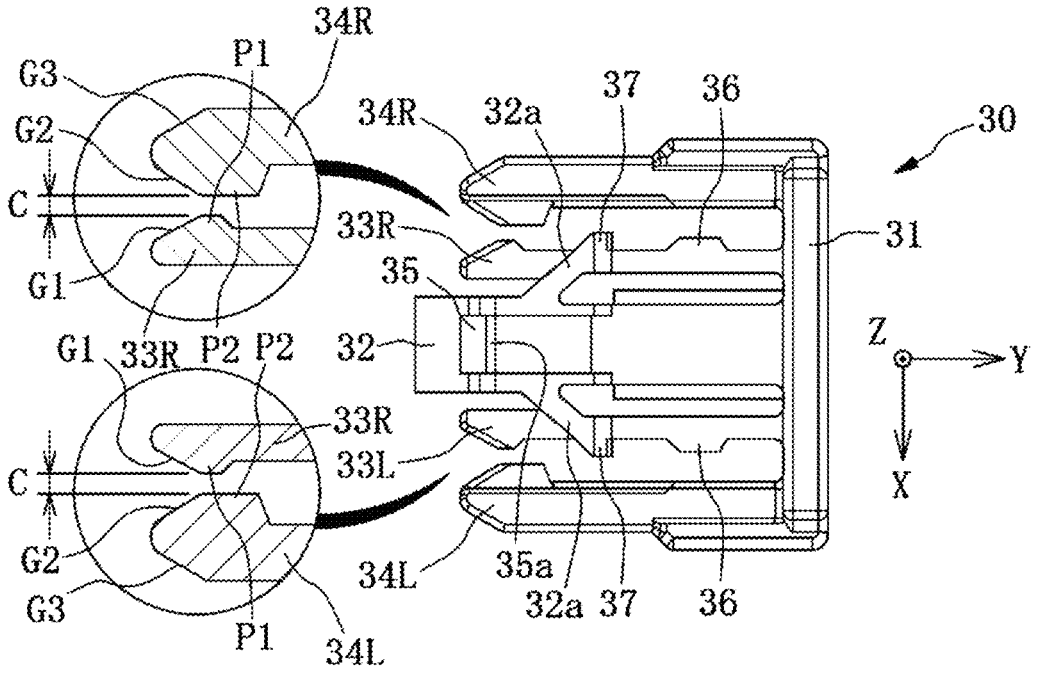
FIG. 9A is a plan view of the sliding member.
Figure 9B:
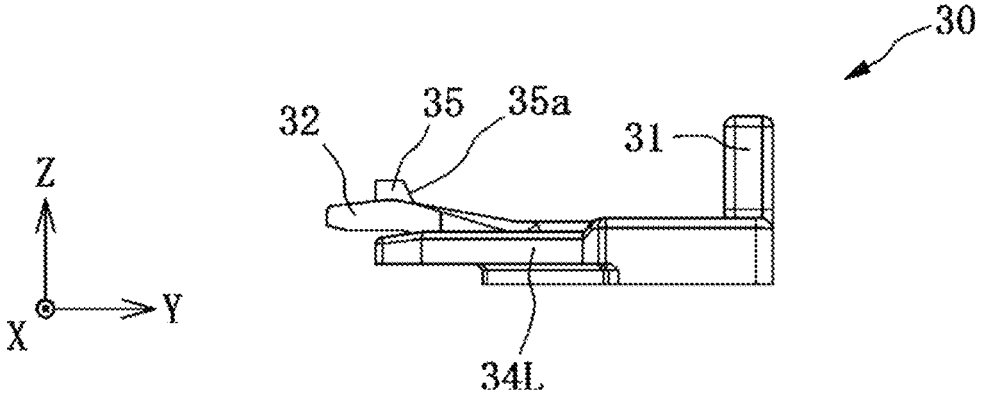
FIG. 9B is a side view of the sliding member.

As illustrated in FIGS. 9A, 9B, the main arm 32 is formed so as to protrude from the sliding member base 31 in the −Y direction. Provided at the leading end of the main arm 32 is the protrusion 35 that protrudes upwardly (+Z direction). A rear end surface 35*a* of the protrusion 35 is formed as an inclined surface inclined in the Y-axis direction. The rear end surface 35*a* serves as a guide surface that guides the moving main arm 32 when the sliding member 30 is slid in the +Y direction.

The latching arms 33R, 33L are formed so as to protrude from the sliding member base 31 in the −Y direction with the main arm 32 being present therebetween. The latching arms 33R, 33L are interlinked with the main arm 32 by an interlinking part 32*a*. In addition, the latching arms 33R, 33L include respective latches 36, and respective tentative latches 37.

Figure 11A:
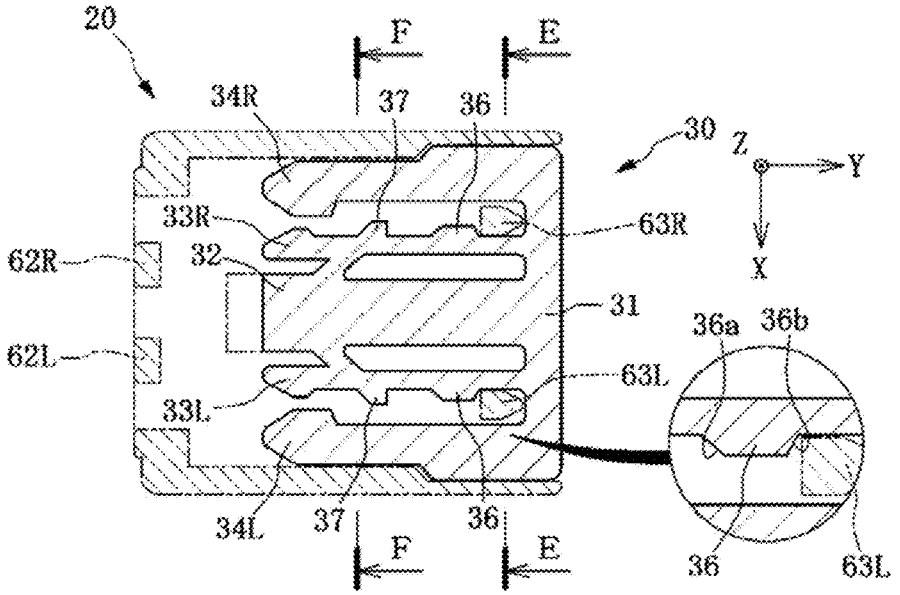
FIG. 11A is an XY cross-sectional view of the sliding member disposed at a second position.

As illustrated in FIG. 11A, the rear-end-side locking arm parts 63R, 63L of the locking arms 60R, 60L are to be latched by the respective latches 36. Hence, the rear-end-side locking arm parts 63R, 63L each serve as a catch to be latched by the respective latches 36. The latches 36 are formed so as to protrude outwardly relative to each other. More specifically, the latches 36 are formed on the surface of the latching arm 33R at the −X side, and the surface of the latching arm 33L at the +X side. In addition, a surface 36*a* of the latch 36 at the −Y side and a surface 36*b* thereof at the +Y side are each formed as an inclined surface inclined in the Y-axis direction. The surfaces 36*a*, 36*b* of the respective latches 36 serve as guide surfaces that guide the rear-end-side locking arm parts 63R, 63L, respectively, while being in contact therewith when the sliding member 30 is slid in the −Y direction and in the +Y direction.

Figure 10A:
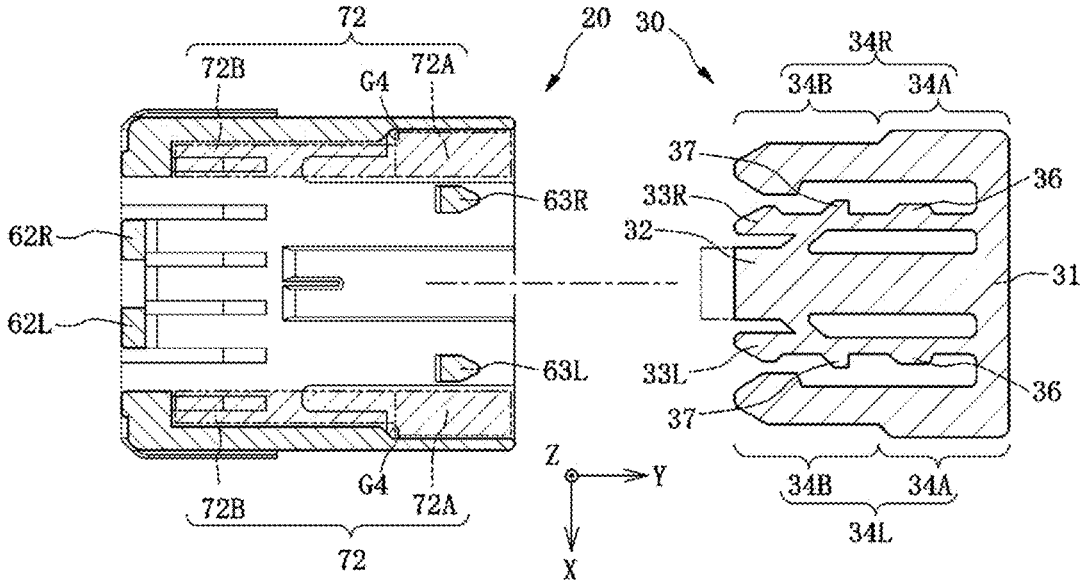
FIG. 10A is a cross-sectional view taken along a line D-D in FIG. 5.
Figure 10B:
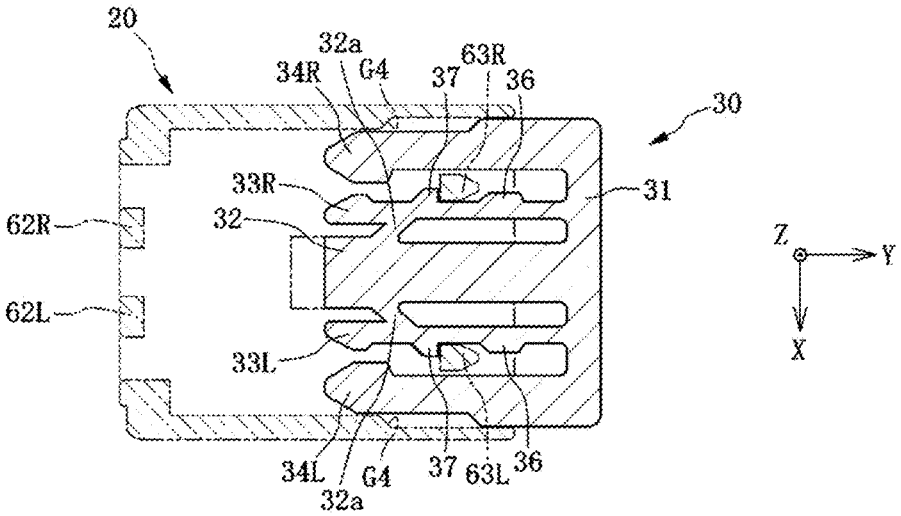
FIG. 10B is an XY cross-sectional view of the sliding member disposed at a first position.

As illustrated in FIG. 10B, the rear-end-side locking arm parts 63R, 63L of the locking arms 60R, 60L are tentatively latched by the respective tentative latches 37. Hence, the rear-end-side locking arm parts 63R, 63L also serve as catches to be tentatively latched by the respective tentative latches 37. The tentative latches 37 prevents the sliding member 30 from moving in the +Y direction upon tentatively latching the rear-end-side locking arm parts 63R, 63L, respectively, thereby preventing the sliding member 30 from pulling out from the inner housing 20. The tentative latches 37 are formed in a shape protruding outwardly relative to each other like the respective latches 36. More specifically, the tentative latches 37 are formed on the surface of the latching arm 33R at the −X side and on the surface of the latching arm 33L at the +X side. In addition, the tentative latches 37 are formed ahead of the respective latches 36 toward a leading end side (−Y side).

Still further, as is clear from the enlarged view that is FIG. 9A, respective guide surfaces G1 are formed at the leading end parts of the latching arms 33R, 33L. The guide surface G1 is formed as an inclined surface inclined in the Y-axis direction. This guide surface G1 is formed so as to improve the fitting easiness by guiding the fitting of the sliding member 30 into the inner housing 20 at the time of manufacturing and assembling of the connector 1, thereby improving the assembling workability.

As illustrated in FIG. 10A, the support arms 34R, 34L are formed so as to protrude from the sliding member base 31 in the −Y direction with the latching arms 33R, 33L being present therebetween. The latching arms 34R, 34L each include a first support arm part 34A, and a second support arm part 34B extended from the rear end of the first support arm part 34A. The second support arm part 34B has a smaller lateral cross-sectional area (the area of the XZ cross-section) than that of the first support arm part 34A. In addition, the first support arm part 34A is formed so as to be engaged with the first rail part 72A of the rail 72. Likewise, the second support arm part 34B is formed so as to be engaged with the second rail part 72B of the rail 72. As explained above, the sliding member 30 and the inner housing 20 include the two engagement components, thereby enhancing the action of preventing the sliding member 30 from being detached from the inner housing 20.

Figure 11B:
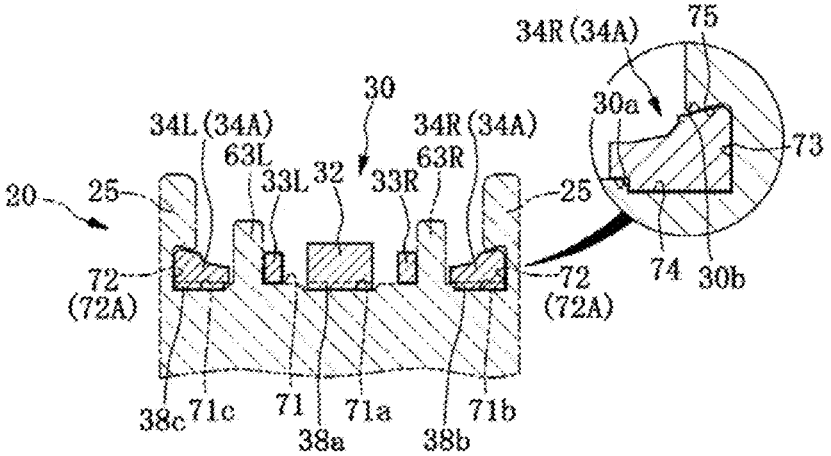
FIG. 11B is a cross-sectional view taken along a line E-E in FIG. 11A.
Figure 11C:
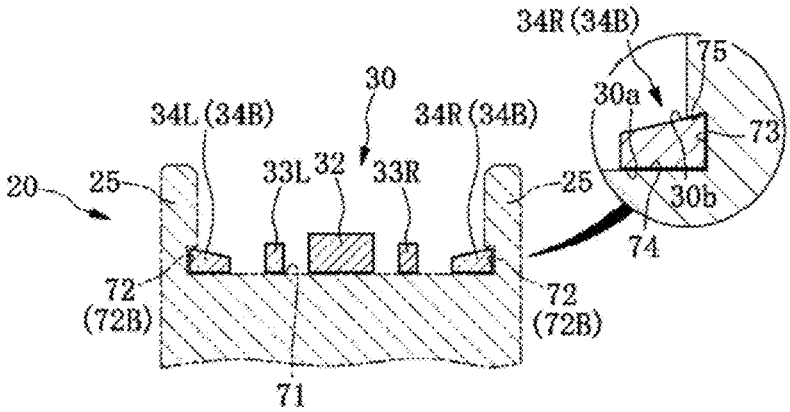
FIG. 11C is a cross-sectional view taken along a line F-F in FIG. 11A.

As illustrated in FIGS. 11B, 11C, the support arms 34R, 34L each include an upper surface 30*b* (second surface) that faces the second side surface 75 of the rail 72 in a recess shape, and the lower surface 30*a* (first surface) that faces the first side surface 74 of the rail 72. The upper surface 30*b* is formed at the opposite side to the lower surface 30*a*, and is formed so as to be inclined relative to the slide surface 71. In addition, the respective upper surfaces 30*b* of the support arms 34R, 34L are formed so as to be inclined in the direction in which the support arms 34R, 34L face with each other. As explained above, when the support arms 34R, 34L are engaged with the respective rails 72 that are respective grooves, the sliding member 30 is prevented from being detached from the inner housing 20. The inclination angle of the upper surface 30*b* is substantially equal to the corresponding inclination angle of the second side surface 75 of the rail 72. The upper surface 30*b* that is an inclination surface is formed on both the first support arm part 34A and the second support arm part 34B.

As is clear from the enlarged view that is FIG. 9A, guide surfaces G2, G3 are formed at the respective leading end parts of the support arms 34R, 34L. The guide surfaces G2, G3 are each formed as an inclined surface inclined in the Y-axis direction. Such guide surfaces G2, G3 are formed so as to improve the fitting easiness by guiding the fitting of the sliding member 30 into the inner housing 20 at the time of manufacturing and assembling of the connector 1, thereby improving the assembling workability.

The latching arms 33R, 33L and the support arms 34R, 34L are formed in the substantially equal length. Hence, as is clear from the enlarged view that is FIG. 9A, the leading end parts of the latching arms 33R, 33L and those of the support arms 34R, 34L are located at the substantially consistent position in the lengthwise direction (Y-axis direction). Provided at the leading end parts of the latching arms 33R, 33L and those of the support arms 34R, 34L are protrusions P1, P2 protruding in the direction facing with each other. The protrusions P1, P2 are formed in a shape and a dimension that do not allow the main arm 32, the latching arms 33R, 33L, and the support arms 34R, 34L, and the like, to enter a gap C formed between the protrusion P1 and the protrusion P2. Hence, the protrusion P1 and the protrusion P2 prevent the sliding members 30 from getting caught each other at the time of manufacturing and assembling of the connector 1.

Figure 12:
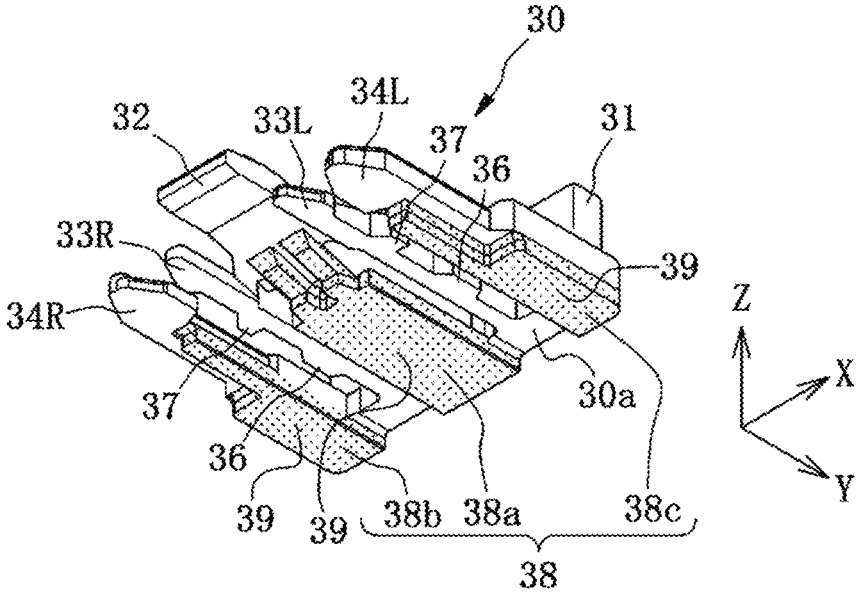
FIG. 12 is a (second) perspective view of the sliding member.

FIG. 12 is a perspective view of the sliding member 30 as viewed from the lower side. As illustrated in FIG. 12, a thickened part 38 that is raised up from the lower surface 30*a* basically planar is formed in the sliding member 30. In FIG. 12, the thickened part 38 is indicated by multiple dots. The thickened part 38 is formed so as to increase the substantial thickness of the sliding member 30, thereby enhancing the strength thereof.

In this embodiment, the thickened part 38 includes a thickened piece 38*a* formed on the lower surface of the main arm 32, a thickened piece 38*b* formed on the lower surface of the support arm 34R, and a thickened piece 38*c* formed on the lower surface of the support arm 34L. As illustrated in FIG. 11B that is a cross-sectional end view taken along a line E-E, the thickened piece 38*a* of the thickened part 38 is formed so as to be engaged with the engagement part 71*a* formed in the slide surface 71. Likewise, the thickened pieces 38*b*, 38*c* are formed so as to be engaged with the engagement parts 71*b*, 71*c*, respectively. Still further, an offset surface 39 that is a plane is formed on each of the thickened pieces 38*a* to 38*c* at an offset position in the −Z direction relative to the lower surface 30*a*. Such offset surface 39 contacts the bottom of each engagement part 71*a* to 71*c*, and is slidable over such a bottom.

Figure 13:
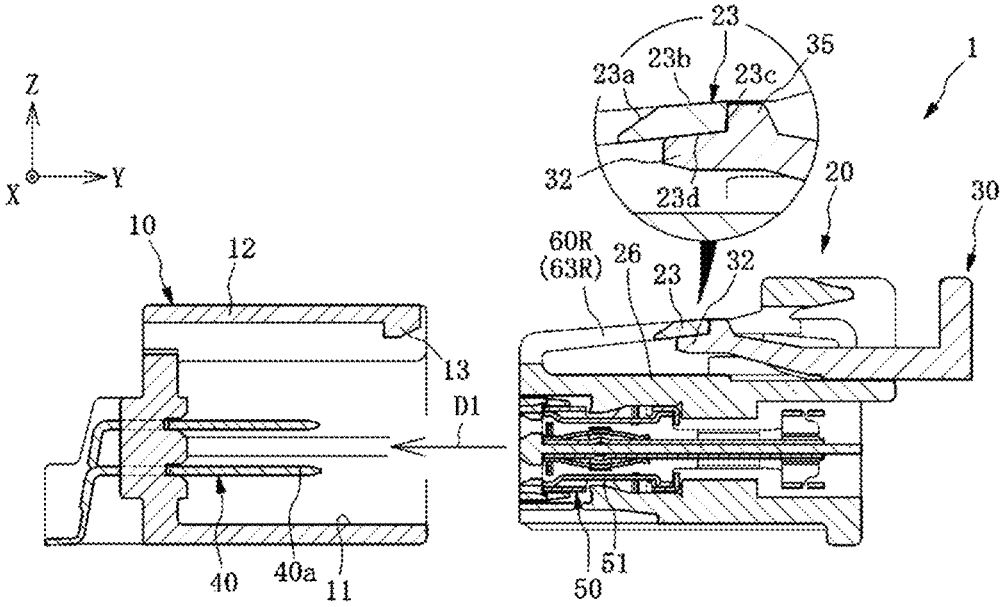
FIG. 13 is a (first) YZ cross-sectional view of the connector for explaining an engagement between an outer housing and an inner housing.

An explanation will be given of how to engage the outer housing 10 of the connector 1 employing the above structure with the inner housing 20 thereof with reference to FIGS. 13 to 17. As illustrated in FIG. 13, with the protrusion 35 formed at the main arm 32 latching the engagement latch 23 and having a sliding action restricted, the sliding member 30 is attached to the inner housing 20. In addition, as illustrated in FIG. 18A, the sliding member 30 in this stage is located at a first position (initial position) where the locking arms 60R, 60L are not latched by the latches 36 of the latching arms 33R, 33L, respectively, and the locking arms 60R, 60L are tentatively latched by the tentative latches 37.

Figure 14:
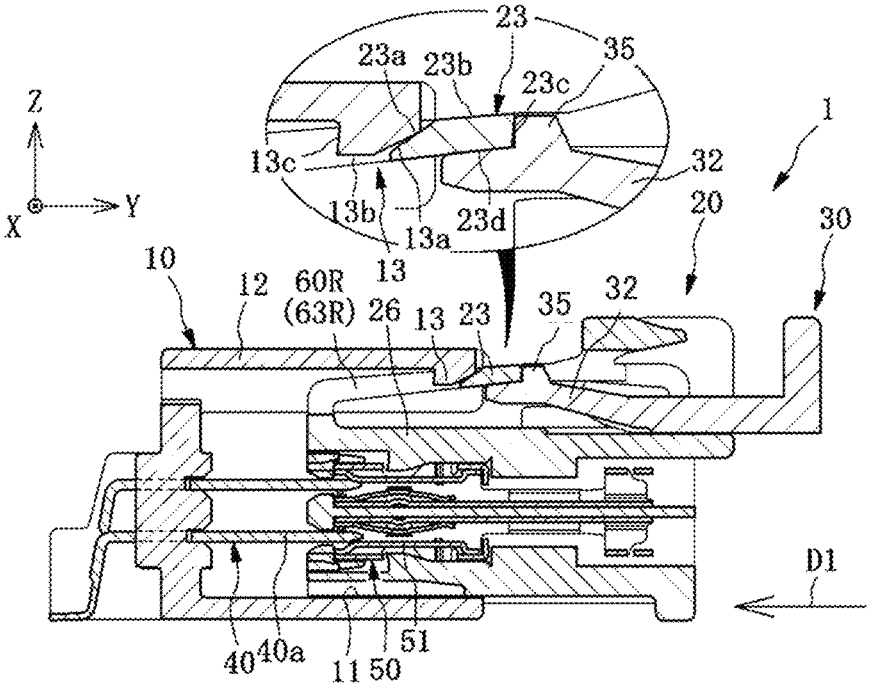
FIG. 14 is a (second) YZ cross-sectional view of the connector for explaining the engagement between the outer housing and the inner housing.

As illustrated in FIG. 14, when the inner housing 20 is being fitted in the engagement opening 11 of the outer housing 10 together with the sliding member 30 in the fitting direction D1, the engagement latch 23 abuts the engagement catch 13. In addition, the leading end part of the end 40*a* of each male terminal 40 enters the cylindrical part 51 of each female terminal 50.

Figure 15:
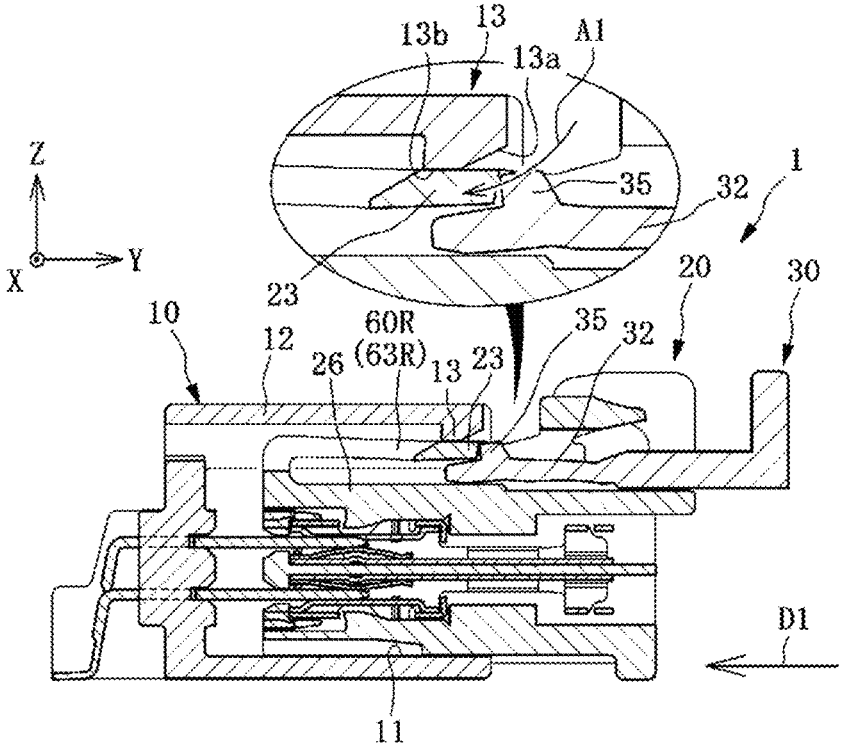
FIG. 15 is a (third) YZ cross-sectional view of the connector for explaining the engagement between the outer housing and the inner housing.

As illustrated in FIG. 15, when the inner housing 20 is further fitted in the engagement opening 11 of the outer housing 10, the engagement latch 23 is guided by the inclined surface 13*a* of the engagement catch 13 together with the protrusion 35 of the sliding member 30. This guiding by the inclined surface 13*a* causes the locking arms 60R, 60L of the inner housing 20 and the main arm 32 of the sliding member 30 to be deflected. Next, by the depression from the engagement catch 13, as indicated by an arrow A1, the engagement latch 23 and the protrusion 35 are pushed downwardly (−Z side).

Figure 16:
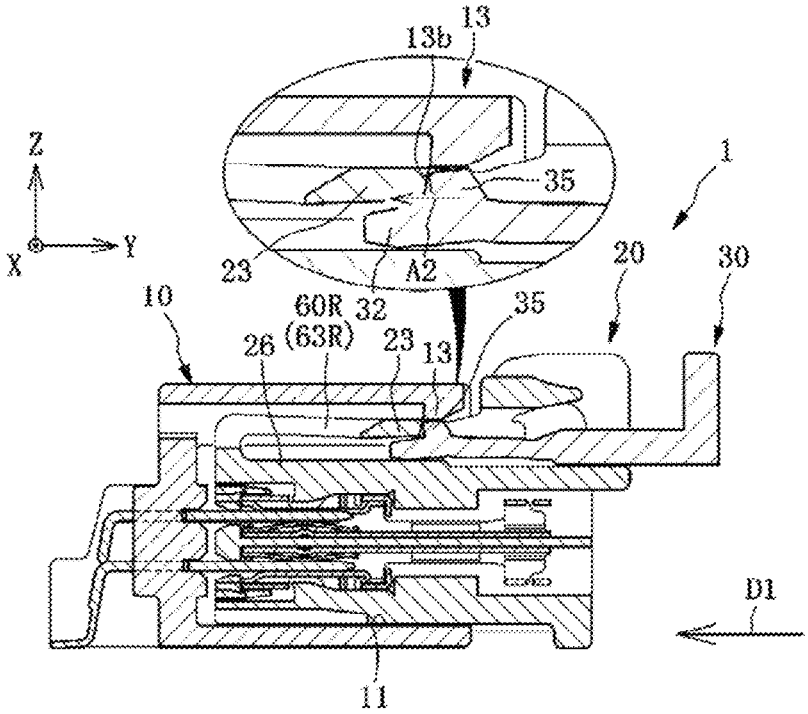
FIG. 16 is a (fourth) YZ cross-sectional view of the connector for explaining the engagement between the outer housing and the inner housing.

As illustrated in FIG. 16, when the inner housing 20 is further fitted in the engagement opening 11 of the outer housing 10, the engagement latch 23 is guided by the parallel surface 13*b* of the engagement catch 13, thus being moved in the −Y direction together with the protrusion 35 of the sliding member 30 as indicated by an arrow A2.

Figure 17:
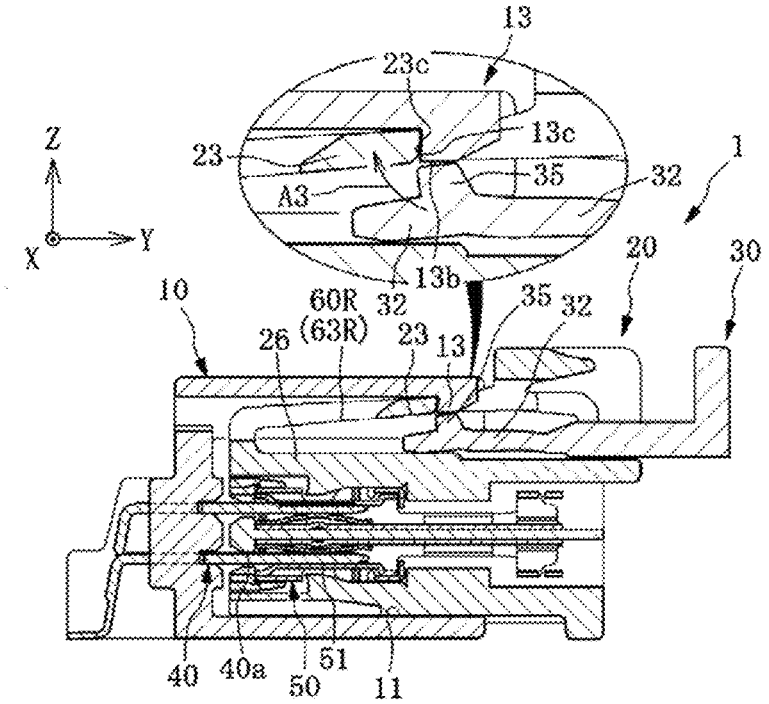
FIG. 17 is a (fifth) YZ cross-sectional view of the connector for explaining the engagement between the outer housing and the inner housing.
Figure 18A:
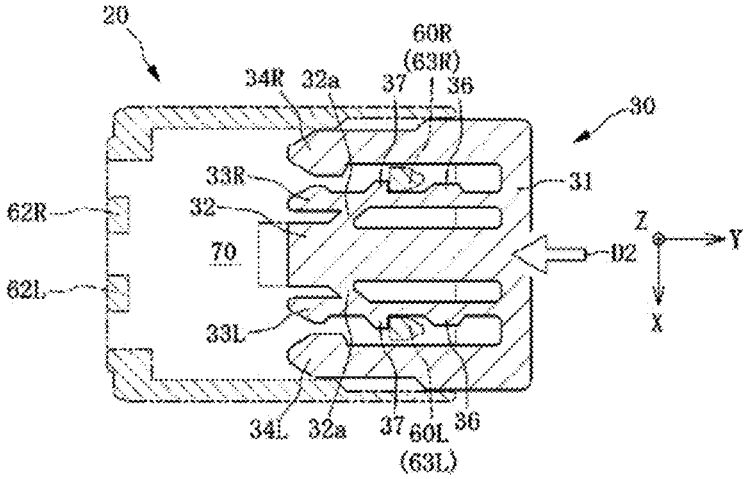
FIG. 18A is a (first) XY cross-sectional view of the sliding member, and the like, for explaining a Connector Position Assurance (CPA) function of the sliding member.

As illustrated in FIG. 17, when the inner housing 20 is further fitted in the engagement opening 11 of the outer housing 10, the standing-upright surface 23*c* of the engagement latch 23 reaches the standing-upright surface 13*c* of the engagement catch 13. When the standing-upright surface 23*c* reaches the standing-upright surface 13*c*, the depression by the engagement latch 13 is canceled, and thus the deflection of the locking arms 60R, 60L is canceled. Next, the engagement latch 23 is returned to the upper side (+Z side) based on the elastic recovery of the locking arms 60R, 60L as indicated by an arrow A3. Consequently, the standing-upright surface 23*c* and the standing-upright surface 13*c* face with each other, and the engagement catch 13 is latched by the engagement latch 23.

At the time point at which the engagement catch 13 is latched by the engagement latch 23, the protrusion 35 is still being guided by the parallel surface 13*b*. Hence, the deflection of the main arm 32 is not canceled yet.

Through the above actions, the engagement between the outer housing 10 of the connector 1 and the inner housing 20 thereof completes. In addition, upon completion of the engagement between both the outer and inner housings 10, 20, the fitting of the end 40*a* of each male terminal 40 into the cylindrical part 51 of each female terminal 50 also completes, and thus each male terminal 40 and each female terminal 50 are electrically connected to each other.

Next, the CPA (Connector Position Assurance) function of the connector 1 will be explained with reference to FIGS. 16 to 20. The initial position of the sliding member 30 in FIG. 18A will be defined as the first position (stand-by position), and the position of the sliding member 30 after the movement illustrated in FIG. 18C will be defined as a second position (engagement locking position).

As illustrated in FIG. 16, when the engagement between both the outer and inner housings 10, 20 has not been fully completed yet, the engagement latch 23 and the engagement catch 13 are not in a latched condition. In addition, the engagement latch 23 as a protrusion catch is latched by the protrusion 35. Hence, the sliding member 30 is in a condition in which the sliding action in the −Y direction is restricted.

As illustrated in FIG. 17, when the engagement between both the outer and inner housings 10, 20 completes, the engagement latch 23 moves upwardly (+Z side) and latches the engagement catch 13. Conversely, when the engagement latch 23 moves upwardly (+Z side), the latching between the protrusion 35 and the engagement latch 23 is released. Hence, the sliding member 30 becomes a condition capable of passing through the slide channel 70 in the −Y direction.

When the engagement between both the outer and inner housings 10, 20 completes, the user who attempts to check the engagement condition between both the outer and inner housings 10, 20 moves the sliding member 30 from the first position (initial position) illustrated in FIG. 18A along the sliding channel 70. Note that the sliding direction D2 of the sliding member 30 is consistent with the −Y direction.

Figure 19:
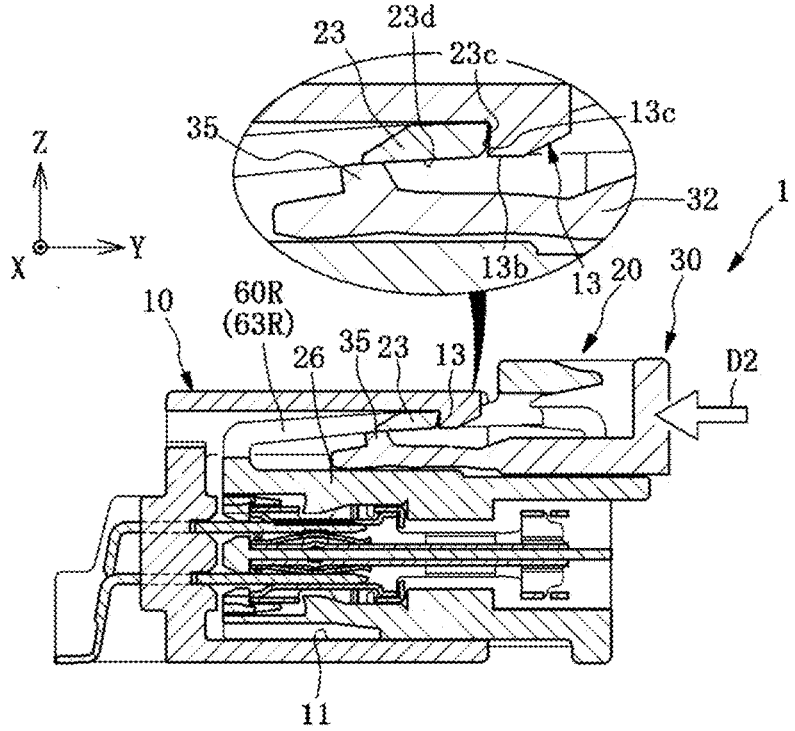
FIG. 19 is a (first) YZ cross-sectional view of the connector for explaining the CPA function of the sliding member.

When the sliding member 30 is being slid, as illustrated in FIG. 19, the protrusion 35 of the sliding member 30 moves from the parallel surface 13*b* of the engagement catch 13 to the lower parallel surface 23*d* of the engagement latch 23, and is guided by the lower parallel surface 23*d*, and thus the sliding member 30 is moved in parallel with the −Y direction. In addition, as illustrated in FIG. 18A, when the sliding member 30 is moved in parallel with the −Y direction, the respective latches 36 of the sliding member 30 abut the locking arms 60R, 60L (more specifically, the respective rear-end-side locking arm parts 63R, 63L).

Figure 18B:
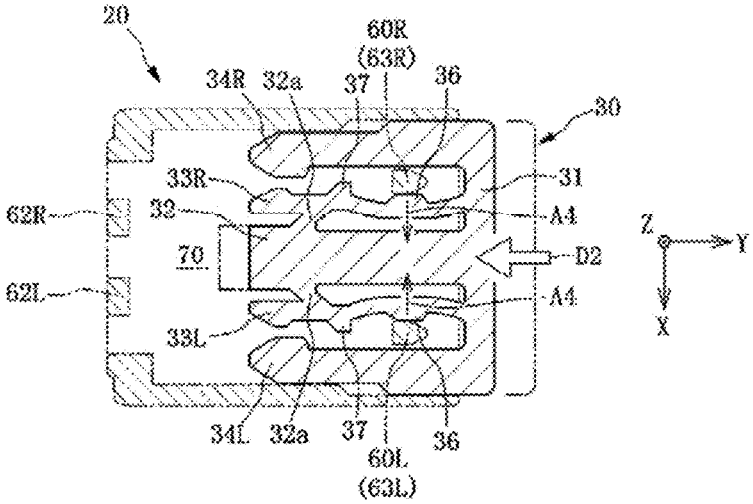
FIG. 18B is a (second) XY cross-sectional view of the sliding member, and the like, for explaining the CPA function of the sliding member.

In addition, as illustrated in FIG. 18B, when the sliding member 30 is further slid, the latches 36 are guided by the locking arms 60R, 60L, respectively, and thus the latching arms 33R, 33L are deflected. Still further, the depressions by the locking arms 60R, 60L causes, as indicated by an arrow A4, the gap between the pair of latching arms 33R, 33L to be decreased.

Figure 18C:
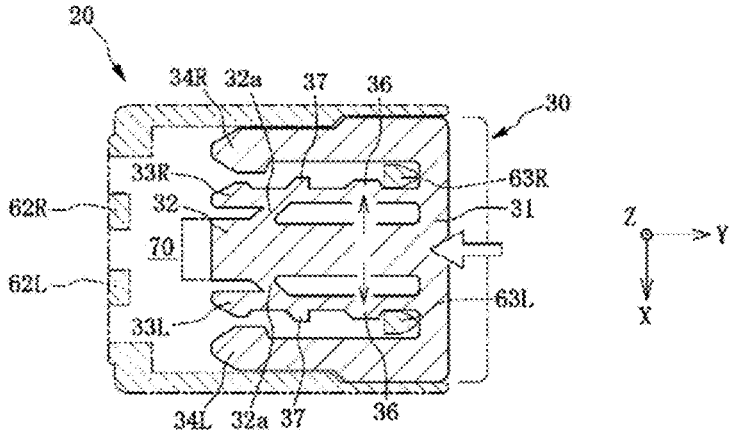
FIG. 18C is a (third) XY cross-sectional view of the sliding member, and the like, for explaining the CPA function.
Figure 20:
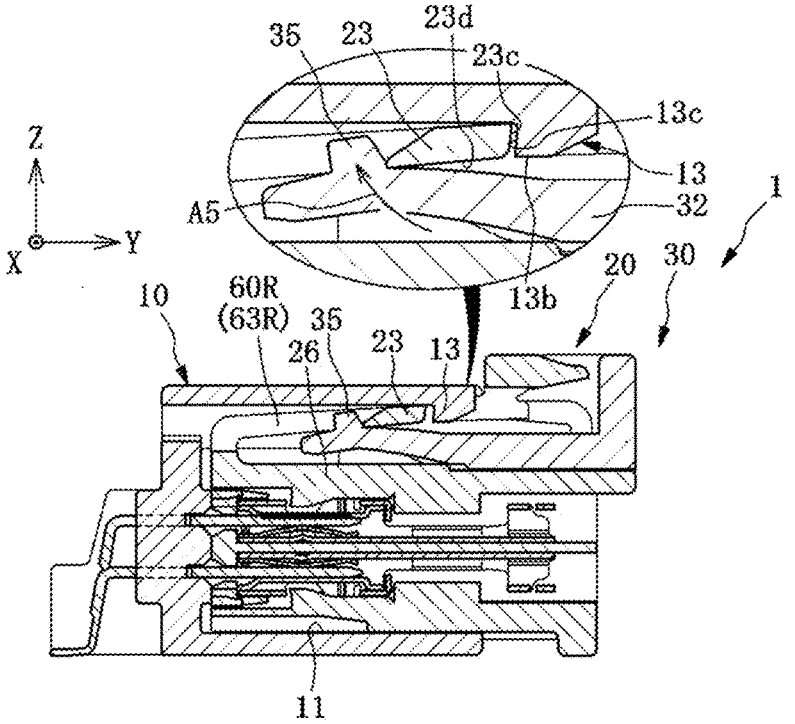
FIG. 20 is a (second) YZ cross-sectional view of the connector for explaining the CPA function of the sliding member.

Yet still further, as illustrated in FIG. 18C, when the sliding member 30 is further slid, the latches 36 go over the locking arms 60R, 60L, respectively, and thus the latching arms 33R, 33L are subjected to elastic recovery, and the gap therebetween increases. Hence, the locking arms 60R, 60L are latched by the latching arms 33R, 33L. In addition, as illustrated in FIG. 20, the protrusion 35 goes over the engagement latch 23, and thus the deflection of the main arm 32 is canceled. Still further, based on the elastic recovery by the main arm 32, as indicated by an arrow A5, the protrusion 35 is returned upwardly (+Z side). Consequently, the engagement latch 23 is latched by the protrusion 35.

When the engagement latch 23 is latched by the protrusion 35, the main arm 32 is positioned below (−Z side) the engagement latch 23. Hence, the engagement latch 23 is not capable of moving by what corresponds to the amount necessary to cancel the engagement with the engagement catch 13, thus not capable of moving down to a position for canceling the engagement. Consequently, the engagement between the outer housing 10 and the inner housing 20 is locked by the sliding member 30.

Through the above actions, the movement of the sliding member 30 from the first position (initial position) illustrated in FIG. 18A to the second position (engagement locking position) illustrated in FIG. 18C completes. The user who pushes the sliding member 30 in the second position becomes able to check whether or not the engagement between both the outer and inner housings 10, 20 has completed.

Next, an explanation will be given of how to detach the inner housing 20 of the connector 1 from the outer housing 10 thereof with reference to FIGS. 21 to 25. As illustrated in FIG. 25, the direction in which the inner housing 20 is pulled out from the outer housing 10 (detaching direction D3) is consistent with the +Y direction.

Figure 23A:
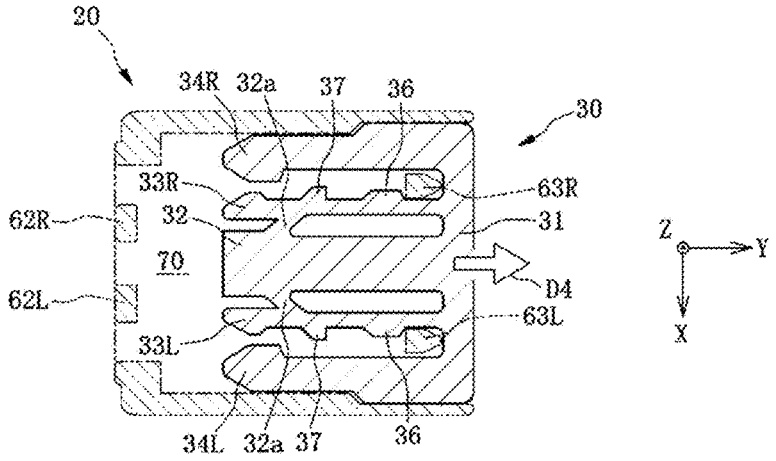
FIG. 23A is a (first) XY cross-sectional view of the sliding member, and the like, for explaining an action at the time of reverse sliding.
Figure 23B:
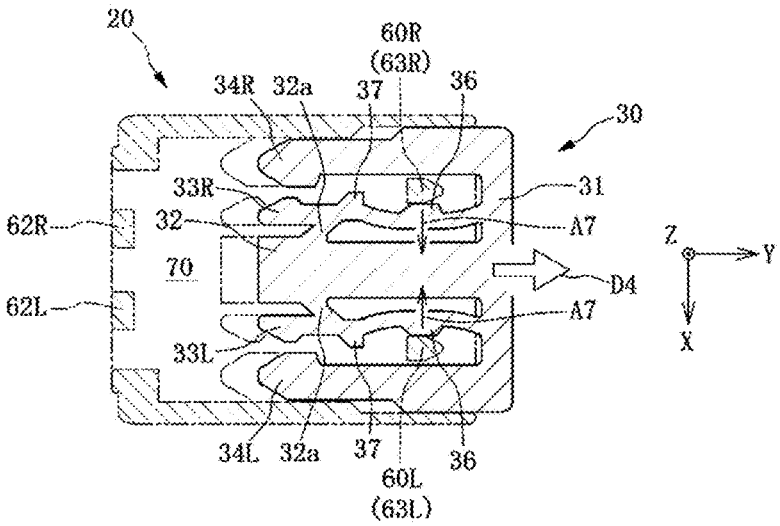
FIG. 23B is a (second) XY cross-sectional view of the sliding member for explaining the action at the time of reverse sliding.
Figure 23C:
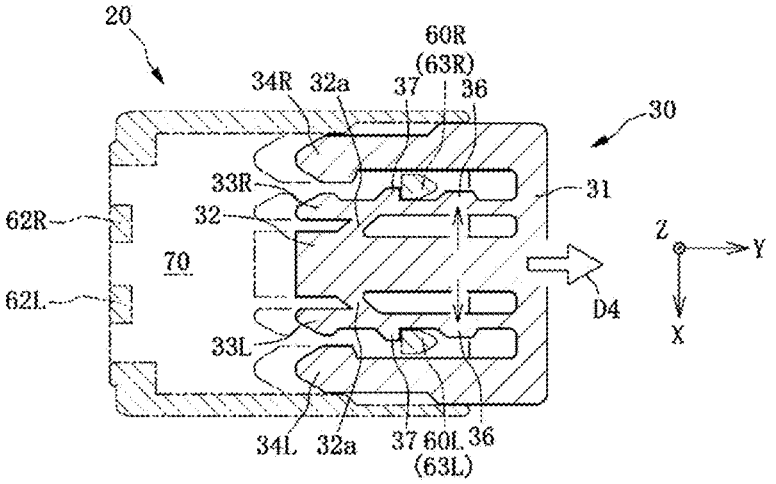
FIG. 23C is a (third) XY cross-sectional view of the sliding member, and the like, for explaining the action at the time of reverse sliding.

When the engagement between the outer housing 10 and the inner housing 20 is to be canceled, first, the sliding member 30 is moved from the second position (engagement locking position) illustrated in FIG. 23A to the first position (initial position) illustrated in FIG. 23C along a reverse sliding direction D4. Hence, the locking by the sliding member 30 is canceled, and a condition is accomplished in which the engagement between both the outer and inner housings 10, 20 can be canceled. Note that the reverse sliding direction D4 of the sliding member 30 is an opposite direction to the sliding direction D2.

Figure 21:
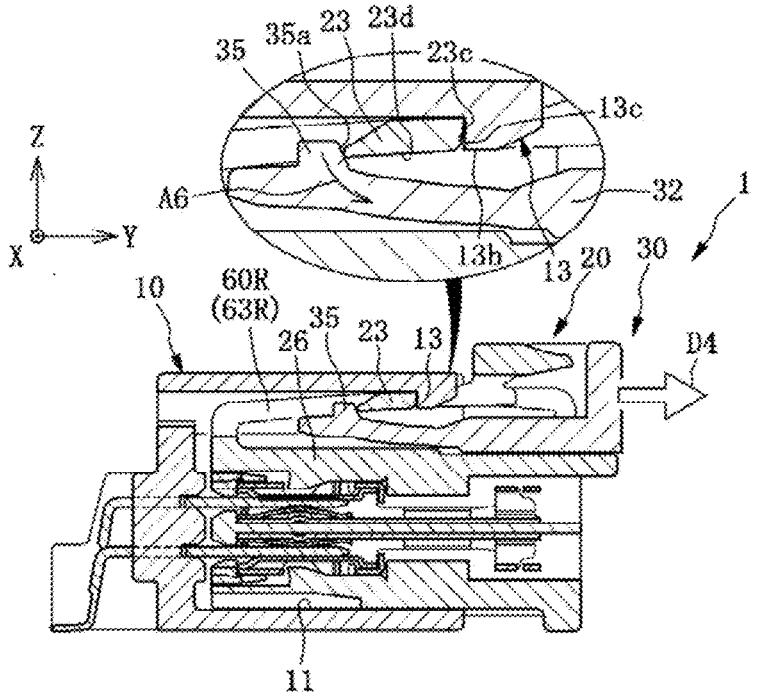
FIG. 21 is a (first) YZ cross-sectional view of the connector for explaining an action when the sliding member is slid in the reverse direction.
Figure 22:
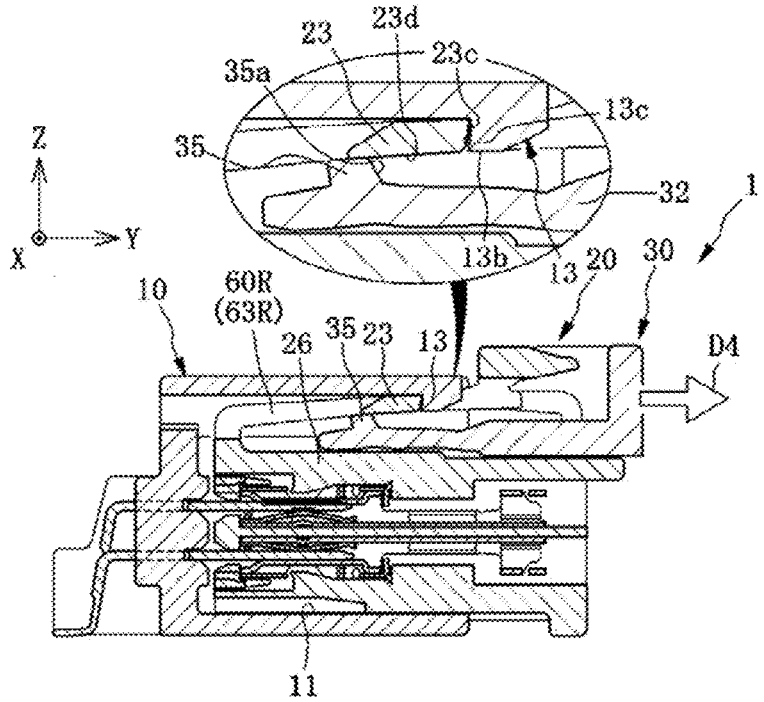
FIG. 22 is a (second) YZ cross-sectional view of the connector for explaining an action when the sliding member is slid in the reverse direction.

When the sliding member 30 is further slid in the reverse sliding direction D4, as illustrated in FIG. 21, the rear end surface 35*a* of the protrusion 35 of the sliding member 30 is guided by the engagement latch 23. Next, as is indicated by an arrow A6, the protrusion 35 moves downwardly (−Z side), and thus the main arm 32 of the sliding member 30 is deflected. Consequently, as illustrated in FIG. 22, the latching between the protrusion 35 and the engagement latch 23 is canceled.

In addition, as illustrated in FIG. 23A, when the sliding member 30 is further slid in the reverse sliding direction D4, as illustrated in FIG. 23B, the latches 36 of the sliding member 30 are guided by the respective locking arms 60R, 60L, and thus the latching arms 33R, 33L are deflected. Hence, as indicated by an arrow A7, the gap between the pair of latching arms 33R, 33L is decreased.

Still further, as illustrated in FIG. 23C, when the sliding member 30 is further slid, the latches 36 go over the locking arms 60R, 60L, respectively, the latching arms 33R, 33L are subjected to the elastic recovery, and the gap between the latching arms 33R, 33L increases. Next, the locking arms 60R, 60L are positioned between the respective laches 36 and the respective tentative latches 37, and the locking arms 60R, 60L are tentatively latched by the tentative laches 37, respectively. This tentative latching restricts a further sliding action of the sliding member 30 in the +Y direction.

Figure 24:
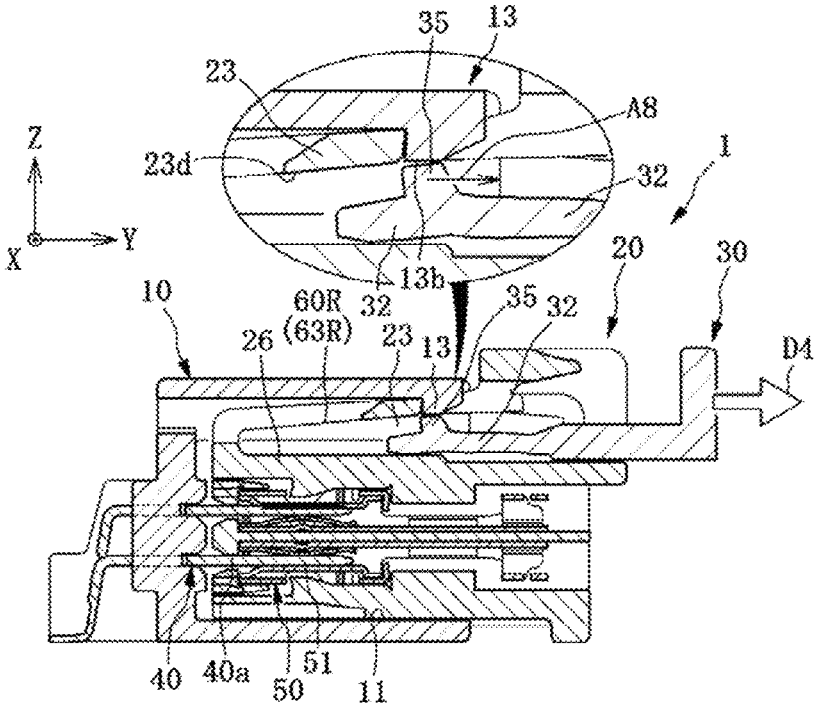
FIG. 24 is a (third) YZ cross-sectional view of the connector for explaining the action when the sliding member is slid in the reverse direction.
Figure 25:
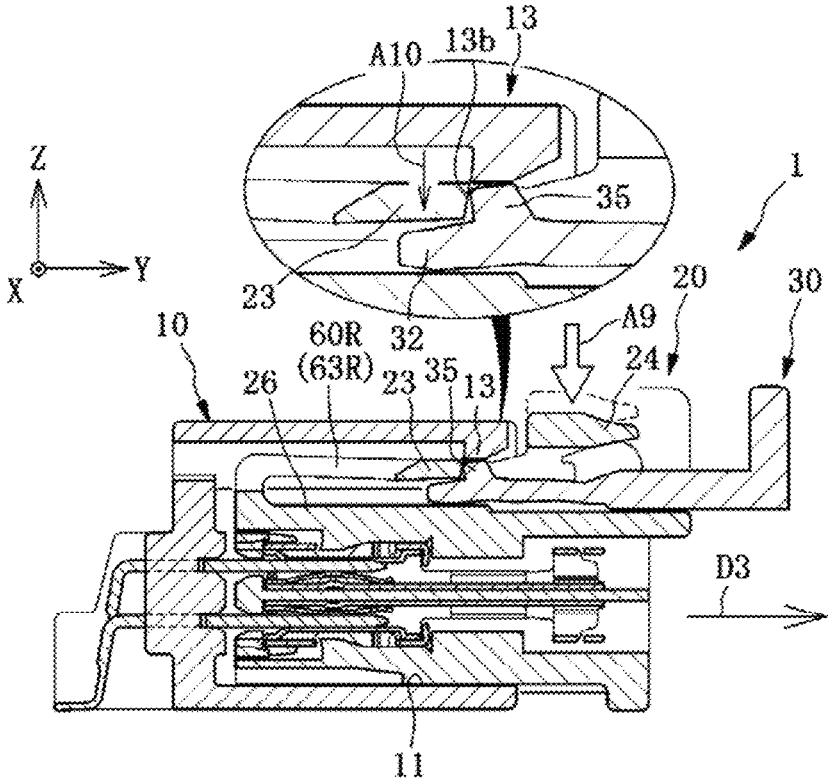
FIG. 25 is an YZ cross-sectional view of the connector for explaining a disengagement between the outer housing and the inner housing.

Yet still further, as illustrated in FIG. 24, when the sliding member 30 is further slid, as indicated by an arrow A8, the protrusion 35 moves from the lower parallel surface 23*d* of the engagement latch 23 to the parallel surface 13*b* of the engagement catch 13. Hence, a space where none of members is present is created below the engagement latch 23, and the move-down amount for the engagement latch 23 necessary to fully cancel the latching with the engagement catch 13 is ensured. Consequently, the engagement between both the outer and inner housings 10, 20 can be canceled.

Next, as illustrated in FIG. 25, the latching release 24 of the inner housing 20 is pushed down as indicated by an arrow A9. This causes the locking arms 60R, 60L to be deflected, and as indicated by an arrow A10, the engagement latch 23 is pushed downwardly (−Z side). Consequently, the latching between the engagement latch 23 and the engagement catch 13 is canceled.

Subsequently, the inner housing 20 is moved in the detaching direction D3, and is pulled out from the outer housing 10. Hence, the detachment of the inner housing 20 from the outer housing 10 completes. Note that when the inner housing 20 is detached from the outer housing 10, the deflection of the locking arms 60R, 60L is canceled, and the latching release 24 returns to the original position.

As explained above, according to this embodiment, as illustrated in FIG. 18B, the pair of latching arms 33R, 33L are deflected so as to decrease the gap therebetween by the depression from the locking arms 60R, 60L. This eliminates the necessary for ensuring the space by what corresponds to the deflection of the latching arms 33R, 33L in the inner housing 20 in the direction in which the gap increases. Consequently, the connector 1 can be downsized while accomplishing the connector position assurance function.

In addition, according to this embodiment, the locking arms 60R, 60L serve as the catches to be latched by the latches 36 of the respective latching arms 33R, 33L. In general, conventional connectors 1 that have no Connector Position Assurance (CPA) function also include the locking arms 60R, 60L. Hence, by applying the sliding member 30 in this embodiment to such a connector 1 that has no connector position assurance function, this connector can easily accomplish the connector position assurance function. In addition, in order to apply the sliding member 30 in this embodiment, an additional formation of a catch to be latched by the latch 36 in the inner housing 20 is unnecessary. Accordingly, the application of the sliding member 30 does not result in an increase in size of the connector 1. Consequently, the connector 1 can be downsized while accomplishing the connector position assurance function.

Still further, since an additional formation of the catch to be latched by the latching arms 33R, 33L in the inner housing 20 is unnecessary, an increase in manufacturing costs of the connector 1 can be prevented.

Yet still further, according to this embodiment, as illustrated in FIG. 18A, the latching arms 33R, 33L are formed with the respective tentative latches 37. The locking arms 60R, 60L (more specifically, the rear-end-side locking arm parts 63R, 63L) are latched by such tentative latches 37, and thus the sliding member 30 is prevented from moving in the opposite direction (+Y direction) to the sliding direction D2. Hence, the detachment of the sliding member 30 from the inner housing 20 prior to the engagement can be prevented. Consequently, the work efficiency for the user who engages both the outer and inner housings 10, 20 is improved.

In addition, the locking arms 60R, 60L serve as the catches to be tentatively latched by the tentative latches 37. Hence, an additional formation of the catch to be tentatively latched by the tentative latch 37 in the inner housing 20 is unnecessary. Hence, an increase in size of the connector 1 is unnecessary. Consequently, the downsizing of the connector 1 can be accomplished while accomplishing the connector position assurance function.

The locking arms 60R, 60L are latched by both the latches 36 and the tentative latches 37, respectively. Since the locking arms 60R, 60L serve as the catches for both the latches 36 and the tentative latches 37, respectively, a separate formation of the catch for the latch 36 and of the catch for the tentative latch 37 is unnecessary. Hence, an increase in size of the connector 1 is unnecessary. Consequently, the downsizing of the connector 1 can be accomplished while accomplishing the connector position assurance function.

The embodiment of the present disclosure has been explained above, but the present disclosure is not limited to the above embodiment.

For example, according to the above embodiment of the present disclosure, the outer housing 10 is the housing of a receptacle connector to be mounted on the wiring board S, while the inner housing 20 is the housing of the plug connector to be connected with the wiring W. However, the present disclosure is not limited to this structure. For example, both the connectors may include respective terminals, and the wirings W may be connected thereto.

In addition, in the above embodiment, the rear-end-side locking arm parts 63R, 63L are extended in the vertical direction from the nearby location to the rear end (+Y side end) of the ceiling wall 26. However, the present disclosure is not limited to this structure. The rear-end-side locking arm parts 63R, 63L may be formed in the other shapes than that of the above embodiment as long as the latches 36 and the tentative latches 37 are capable of latching.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A connector comprising:

a first housing comprising an engagement catch;

a second housing comprising an engagement latch to latch the engagement catch, a pair of locking arms each provided with the engagement latch, and a slide channel having the pair of locking arms disposed at both sides, the second housing being to be engaged with the first housing; and a sliding member comprising a pair of arms each provided with a latch, wherein:

when the first housing and the second housing are engaged with each other, the first housing and the second housing allow the sliding member to pass through the slide channel; and when the sliding member slides the slide channel, the pair of arms are deflected so as to decrease a gap therebetween by depressions from the respective locking arms, and when the latches go over the respective locking arms, the gap between the pair of arms increases, the increase in the gap enabling the locking arms to be latched by the respective latches.

2. The connector according to claim 1, wherein:

the sliding member comprises a protrusion; and the engagement latch is latched by the protrusion to restrict a sliding action of the sliding member until the engagement catch is latched by the engagement latch for the engagement between the first and second housings, when the engagement catch is latched by the engagement latch, the latching between the protrusion and the engagement latch is canceled and the canceling of the latching between the protrusion and the engagement latch enables the sliding member to pass through the slide channel.

3. The connector according to claim 1, wherein the pair of arms each comprise a tentative latch that prevents a movement in an opposite direction to the sliding action upon latching each of the locking arms of the second housing, the tentative latch being provided ahead of the latch toward a leading end.

4. The connector according to claim 1, wherein the respective latches of the pair of arms are formed in a shape protruding outwardly relative to each other.

5. The connector according to claim 1, wherein the respective first and second housings are housings of the connector that comprises a terminal connected to a wiring.

* * * * *